US009795973B2

(12) United States Patent
Yuan et al.

(10) Patent No.: US 9,795,973 B2
(45) Date of Patent: Oct. 24, 2017

(54) NEEDLE FOR A JET DEVICE

(71) Applicant: GUANGZHOU SEAGULL KITCHEN AND BATH PRODUCTS CO., LTD., Guangzhou, Guangdong (CN)

(72) Inventors: Xunping Yuan, Guangdong (CN); Zhiqiang Tang, Guangdong (CN)

(73) Assignee: GUANGZHOU SEAGULL KITCHEN AND BATH PRODUCTS CO., LTD., Guangdong (CN)

( * ) Notice: Subject to any disclaimer, the term of this patent is extended or adjusted under 35 U.S.C. 154(b) by 119 days.

(21) Appl. No.: 14/419,206

(22) PCT Filed: Sep. 26, 2013

(86) PCT No.: PCT/CN2013/084278
§ 371 (c)(1),
(2) Date: Feb. 2, 2015

(87) PCT Pub. No.: WO2014/173071
PCT Pub. Date: Oct. 30, 2014

(65) Prior Publication Data

US 2015/0238981 A1 Aug. 27, 2015

(30) Foreign Application Priority Data

Apr. 27, 2013 (CN) ..... 2013 1 0153989

(51) Int. Cl.
*F02M 61/12* (2006.01)
*B05B 1/02* (2006.01)
(Continued)

(52) U.S. Cl.
CPC ..... *B05B 1/02* (2013.01); *B05B 1/3046* (2013.01); *B05B 7/0408* (2013.01); *B05B 7/06* (2013.01);
(Continued)

(58) Field of Classification Search
CPC ..... B05B 1/3046; F02M 5/125; F02M 61/12; F02M 61/162; F02M 61/163; F02M 51/0678; F02M 61/042; F16K 1/385
(Continued)

(56) References Cited

U.S. PATENT DOCUMENTS 1,994,389 A * 3/1935 Frisco ..... B05B 1/308 239/451
5,020,498 A * 6/1991 Linder ..... F02M 45/06 123/446
(Continued)

FOREIGN PATENT DOCUMENTS

JP 2008-012403 * 1/2008 ..... B05B 7/06

*Primary Examiner* — Alexander Valvis
(74) *Attorney, Agent, or Firm* — Osha Liang LLP

(57) ABSTRACT

A needle for a jet device includes a needle body and a tapered part arranged at the end of the needle body, in which the needle body is circumferentially provided with supporting bodies, so that when the needle is assembled in a nozzle of the jet device, the outer surfaces of the supporting bodies are coordinated with an inner chamber of the nozzle to limit the position of the needle body and form fluid channels among the supporting bodies, thereby to effectively prevent the needle from deviating from the spout of the nozzle or from radially swinging.

6 Claims, 3 Drawing Sheets

(51) Int. Cl.

| | |
|---|---|
| ***F02M 61/16*** | (2006.01) |
| ***F02M 61/04*** | (2006.01) |
| ***F02M 51/06*** | (2006.01) |
| ***B05B 7/06*** | (2006.01) |
| ***B05B 1/30*** | (2006.01) |
| ***B05B 7/04*** | (2006.01) |

(52) U.S. Cl.
CPC ..... *F02M 51/0678* (2013.01); *F02M 61/042* (2013.01); *F02M 61/12* (2013.01); *F02M 61/163* (2013.01)

(58) Field of Classification Search
USPC ..... 239/132, 135, 139
See application file for complete search history.

(56) References Cited

U.S. PATENT DOCUMENTS

| | | | | |
|---|---|---|---|---|
| 5,228,604 | A * | 7/1993 | Zanini | B67C 3/281 222/504 |
| 7,798,433 | B2 * | 9/2010 | Onishi | F02M 61/1853 239/533.2 |
| 8,312,902 | B2 * | 11/2012 | Mengibar Rivas | B67C 3/281 141/192 |
| 2008/0154212 | A1 * | 6/2008 | Schraga | A61M 5/322 604/220 |
| 2009/0301605 | A1 * | 12/2009 | Mengibar Rivas | B67C 3/281 141/260 |

* cited by examiner

NEEDLE FOR A JET DEVICE

CROSS REFERENCE TO RELATED APPLICATIONS

This is a national stage application based on PCT/CN2013/084278, filed on Sep. 26, 2013, which claims priority to Chinese Patent Application No. CN 201310153989.5, filed on Apr. 27, 2013. This application claims the benefits and priority of these prior applications and incorporates their disclosures by reference in their entireties.

FIELD OF THE INVENTION

The present invention relates to the field of jet device, in particular to a needle for a jet device.

BACKGROUND OF THE INVENTION

Typically, a jet device comprises a nozzle and a needle mounted in an inner cavity of the nozzle. So far, the needle is generally with an elongated structure, the head of the needle is needle-like, and the needle is movable in the axial direction of the nozzle when an external force acts on, thereby adjusting the cross-section for water flow formed by the needle and the nozzle to regulate and control the nozzle jet flow. This type of jet device is widely used in hot water system for households, hotels and the hotel.

An example of a water mixing valve is disclosed in Chinese patent literature under No. 102086941B, the mixing valve includes a valve body provided with a cold water inlet on the valve body, the cold water inlet valve is in communication with a nozzle, said nozzle is provided with a needle valve for assisting the adjustment of cold water flow, and the cross-section area of water outlet of the nozzle is adjustable by screwing the needle valve in or out.

A further example of an adjustable jet device with multiple water sources is disclosed in Chinese patent literature under No. 102767210A, the jet device includes a jet body, a fluid working cavity and a needle, the fluid working cavity is disposed in the jet body, the front end of the fluid working cavity is provided with a nozzle, a needle is disposed on the extension line of the center line of the fluid working cavity, the end of the needle is provided with a needle stroke control means, wherein the needle can be moved in the axial direction of the nozzle under the control of the needle stroke control means to adjust the jetting flow of nozzle.

In practice, in order to reduce production costs for companies, the conventional needle (needle valve) for a hot water system is provided with an elongated structure, which is the same as that illustrated respectively in the drawings of above two patent literatures. However, after research, it is found that there are some defects for such elongated needle in practical use, i.e. the pressure put on the elongated needle in its radial direction is small when the pressure of the fluid flowing through the nozzle is small, which can meet the operation requirements. However, when the pressure of the fluid flowing through the nozzle is large or even very large and the fluid flow rate is instable, a larger and uniform pressure will occur and be put on the needle in its radial direction, i.e., in the elongation direction of the needle, then the different portions will have different radial pressure put thereon, which may cause a deviation of the water outlet of the needle, or cause a radial wobbling of the needle, thereby affecting the jetting effect of the nozzle.

If the needle with larger diameter is designed in order to solve the above problems, it will inevitably lead to an increase with weight of entire jet device and also the production costs correspondingly.

SUMMARY OF THE INVENTION

The technical problem to be solved by the invention is that the needle of conventional jet device is apt to wobble or deviate with the water outlet of nozzle under the action of the fluid, therefore, it is one objective of the invention to provide a needle for a jet device which has simple structure, easy installation, stable operation under different fluid pressures and flow rates.

To achieve the above objective, in accordance with one embodiment of the invention, there is provided a needle for a jet device, comprising a needle body, and a conical portion disposed on one end of the needle body, the needle body is circumferentially provided with a supporting member, and an outer surface of the supporting member coordinates with an inner cavity of a nozzle, in order to limit the position of the needle body and to form a fluid passage at the supporting member, as the needle is disposed inside the nozzle of a jet device.

In a class of this embodiment, the supporting member comprises a plurality of ribs uniformly and circumferentially arranged around the needle body and extending in the axial direction of the needle body, and each two the ribs have one the fluid passage formed therebetween.

In a class of this embodiment, the rib comprises a first rib part and a second rib port; and the first rib part is arranged towards the cold water inlet of the nozzle, and has a radial dimension smaller than that of the second rib part, so as to coordinate with the inner wall of the nozzle to form the fluid passage, and a coordination is formed between an outer surface of the second rib part and the inner cavity of the nozzle.

In a class of this embodiment, the inner chamber wall of the nozzle is formed a slotting corresponding to the second rib portion, the second rib portion can coordinate into the slotting, and can slide along with the axial direction of the nozzle.

In a class of this embodiment, the inner wall of the nozzle has a groove formed thereon, which corresponds to the second rib part, and the second rib part is adapted for being fitted in the groove and sliding in the axial direction of the nozzle.

In a class of this embodiment, the number of the ribs is three, four, five or six.

In a class of this embodiment, the supporting body is an annular supporting plate disposed on the needle body, a plurality of diversion outlets is formed on the board of the annular supporting plate as the fluid passages.

In a class of this embodiment, the supporting member is a circular ring, the circular ring is connected with the needle body through a plurality of rib strips, and each two rib strips have one the fluid passage formed therebetween.

In a class of this embodiment, the supporting member of the needle body and the conical portion have a water pressurizing and mixing segment formed therebetween, and the water pressurizing and mixing segment is cylindrical in shape.

In a class of this embodiment, the diameter of the water pressurizing and mixing segment is larger than, or equal to, or slightly smaller than the diameter of a water outlet of the nozzle.

In a class of this embodiment, the diameter of the conical portion is larger at a root thereof and smaller at a front end thereof, and the conical degree of the conical portion is 10°-150°, and the length of the conical portion is smaller than or equal to the length for which the nozzle is movable.

In a class of this embodiment, the diameter of the conical portion is gradually reduced in a linear manner from the root to the front end.

Advantages of the above technical solution of the present invention, compared to prior art, are summarized as follows:

The needle for a jet device of the present invention, wherein, the needle body is circumferentially provided with a supporting member, and an outer surface of the supporting member coordinates with an inner cavity of the nozzle, in order to limit the position of the needle body and to form a fluid passage on the supporting member, as the needle is disposed inside the nozzle of a jet device, so that when the pressure of the fluid flowing through the nozzle is large or even very large and the fluid flow rate is instable, it may effectively prevent the needle from deviating from the water outlet of the nozzle, or a radical wobbling of the needle, affecting the jetting effect of the nozzle, due to a larger and non-uniform pressure occur and be put on the needle in its radial direction of the nozzle.

The needle for a jet device of the present invention, wherein, the supporting body comprises a plurality of ribs, which surround the needle body and are uniformly distributed in the circumferential direction, and extend in the axial direction of the needle body, the ribs form the fluid passages between each other, thereby facilitating the flow of fluid, further, each rib comprises the first rib part and the second rib part, and the radical dimension of the first rib part is smaller than the second rib part, so it is possible to further enhance the jetting effect of the nozzle.

The needle for a jet device of the present invention, wherein, the supporting member of the needle body and the conical portion have a water pressurizing and mixing segment formed therebetween, and the water pressurizing and mixing segment is cylindrical in shape, allows the water introduced to the fluid flow passages to be uniformly mixed and pressurizing effect to be achieved, so as to ensure the final jetting effect of the nozzle.

BRIEF DESCRIPTION OF THE DRAWINGS

In order to make the present invention clearly understood more easily, detailed description is further presented below, in conjunction with accompany drawings, wherein.

BRIEF DESCRIPTION OF THE MAKING NUMBERS IN THE ACCOMPANYING DRAWINGS

1—needle body, 1*a*—water pressurizing and mixing segment, 2—conical portion, 2*a*—root, 2*b*—front end, 3—fluid passage, 4—rib, 41—first rib part, 42—second rib part, 5—annular supporting board, 6—diversion hole, 7—circular ring, 8—rib strip, 10—water outlet.

DETAILED DESCRIPTION OF THE EMBODIMENTS

Figure 1:
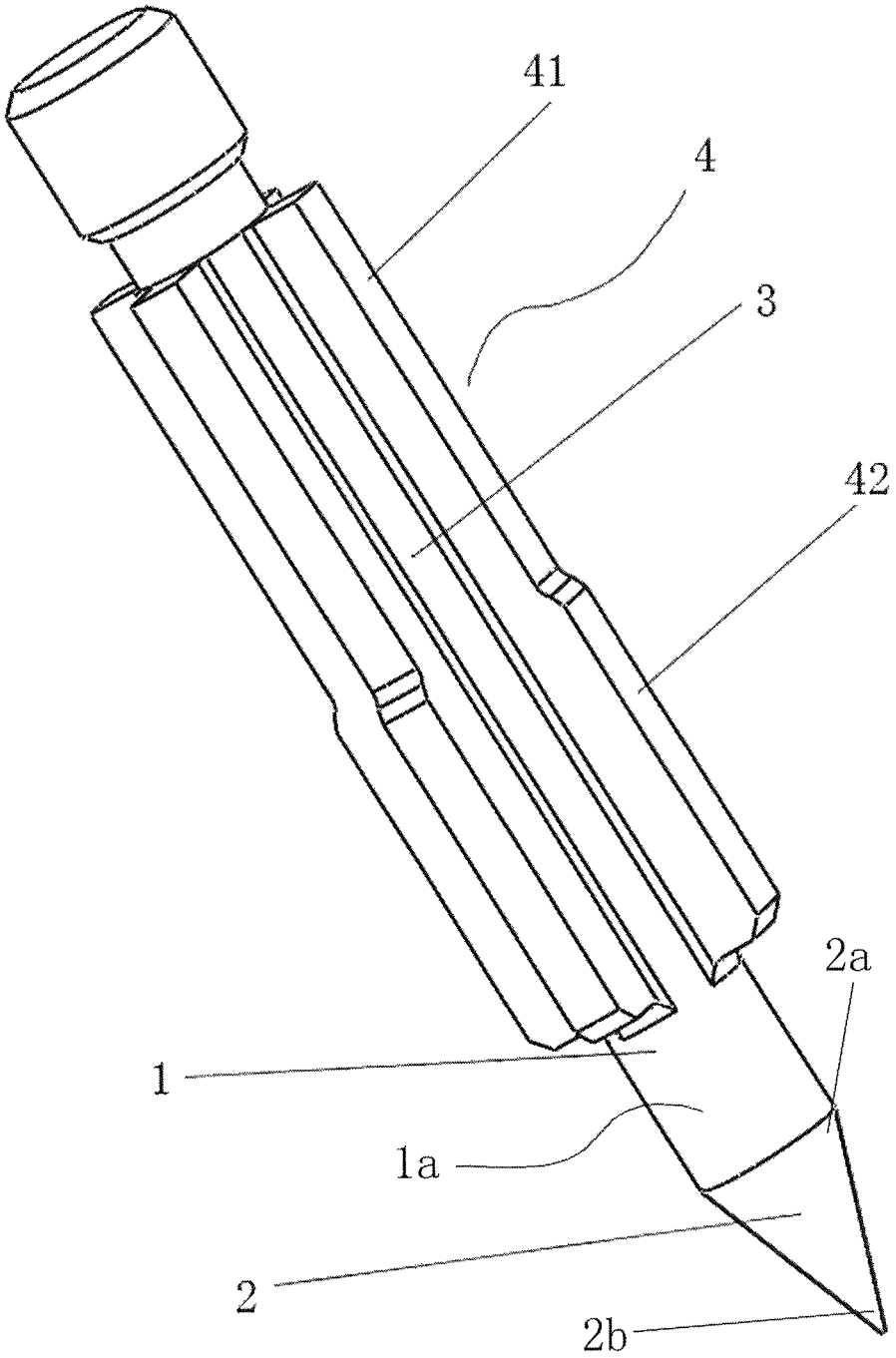
FIG. 1 is a schematic view of three-dimensional structure of the needle of one embodiment of the present invention.
Figure 2:
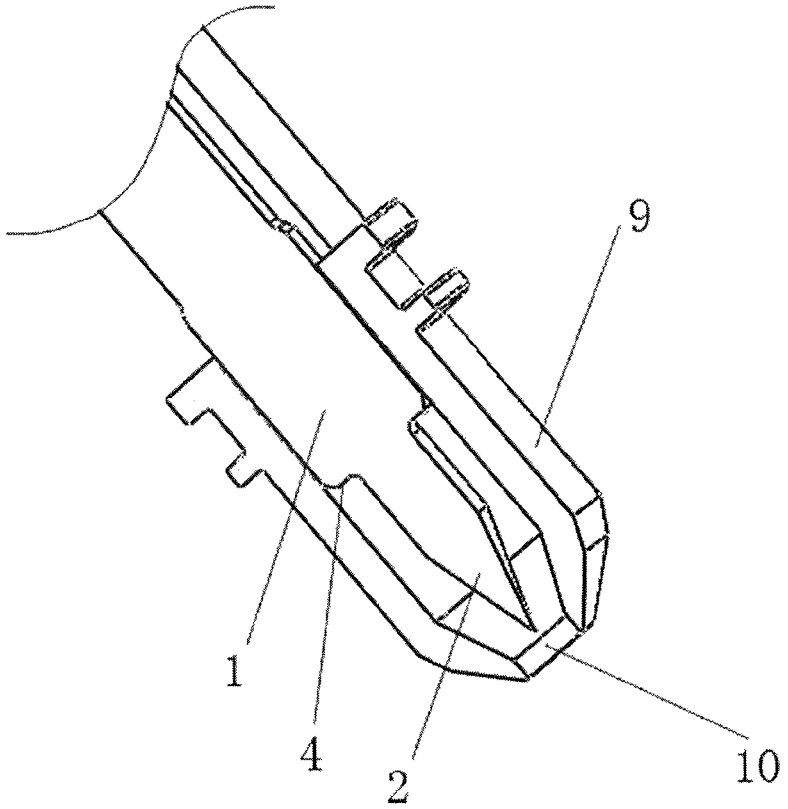
FIG. 2 is a schematic view of one part of the structure showing the coordination between the needle with the nozzle.

As shown in FIGS. 1 and 2, the needle provided by this embodiment of the present invention, comprises a needle body 1, and a conical portion 2 disposed on one end of the needle body 1, wherein, an outer surface of the needle body 1 is circumferentially provided with a supporting member, such that when the needle is assembled to the nozzle 9 of a jet device, an outer surface of the supporting member can coordinate or contact with the inner cavity of the nozzle 9, in order to limit the position of the needle body 1, and accordingly form a fluid passage 3 for fluid flowing at the supporting member.

The needle with such structure used in practice, even when the pressure of fluid flowing through the nozzle 9 is large or even very large and the fluid flow rate is instable, i.e., in the elongation direction of the needle, even the different portions will have different radial pressure put thereon, on the premise that the smooth flow of the fluid should not be affected, due to a larger and non-uniform pressure will occur and put on the needle in its radial direction, it can also effectively prevent the needle from deviating from the water outlet of the nozzle 9, or causing a radial wobbling of the needle, thereby avoiding affecting the jetting effect of the water outlet 10 of the nozzle 9.

According to the role and function of the supporting member as described above, in the actual structures, detailed description on the supporting member is further presented below, but it is to be understood thon the supporting member is not to be limited to the following structures, numerous variations, substitutions and modification be took by those skilled in the art.

The first embodiment of the structure of the supporting member:

In this embodiment, the supporting member comprises a plurality of ribs 4 circumferentially and uniformly arranged around the needle, and each two ribs have one the fluid passage 3 formed therebetween, as shown in FIG. 1. thus, after the needle is assembled to the nozzle, the ribs 4 can coordinate with the inner cavity of the nozzle in contact manner to limit the position of the needle body.

In the actual processing, the rib 4 can be formed by the way of machining such as cutting, can also be one-step molded with the needle body by the way of casting or injection molding etc, appropriate molding method can be selected according to actual needs.

Further, in order to enhance the jetting effect of the nozzle, the ribs 4 comprises a first rib part 41 and a second rib part 42, wherein, after the ribs coordinate with the nozzle, the first rib part 41 is arranged towards the cold water inlet of the nozzle, and has a radial dimension smaller than that of the second rib part 42, so as to coordinate with the inner wall of the nozzle to form the fluid passages 3, so as to uniformly guide the water from the inlet of the nozzle into the fluid passages 3 of the needle, a coordination is formed between an outer surface of the second rib part 42 and the inner cavity of the nozzle 9, so as to ensure the position for the needle can be limited by the supporting member through improving the structure of the rib 4, at the same time, and enhance the jetting effect of the nozzle 9.

The length of the first rib part 41 depends on the axial dimension of water inlet of the nozzle, is usually equal to a sum of the length of water inlet of the nozzle in the axial direction and the length for which the nozzle is movable.

It should be noted that, the first rib part 41 may be a cylinder, but in order to enhance the strength of the needle body 1, preferably, the rib 4 comprises the first rib part 41.

Furthermore, the external diameter of the second rib part 42 depends on the cross-section area of the entire fluid passages 3, which is larger than the jetting cross-section area after the coordination between the nozzle and the needle, so as to ensure minimization of the loss of water pressure of the nozzle outlet.

At this time, the needle both can move back and forth in the axial direction of the nozzle and can rotate in the nozzle by the supporting member providing a limitation to the position.

In practice, the inner cavity wall of the nozzle 9 has a groove formed thereon, which corresponds to the second rib part 42, the groove extending in the axial direction of the nozzle 9, and the second rib part 42 is adapted for being fitted in the groove and sliding in the axial direction of the nozzle. In this structure, the groove is able to guide the needle and prevent the same for rotating, i.e. the needle only can move in the axial direction of the nozzle back and forth, and cannot rotate in the nozzle.

In order to facilitate manufacturing work and ensure that no loss of water pressure is incurred before the cold water reaches the nozzle outlet, the number of the ribs 4 is preferably three, four, five or six, thereby ensuring the sum of the cross-section areas of fluid passages 3 formed by the ribs therebetween is larger than the jetting cross-section area of the nozzle, to ensure no loss of water pressure is incurred or a slight loss of water pressure is incurred before the cold water reaches the nozzle outlet. However, the number of the ribs 4 is not limited to this, may be two or more.

Figure 4:
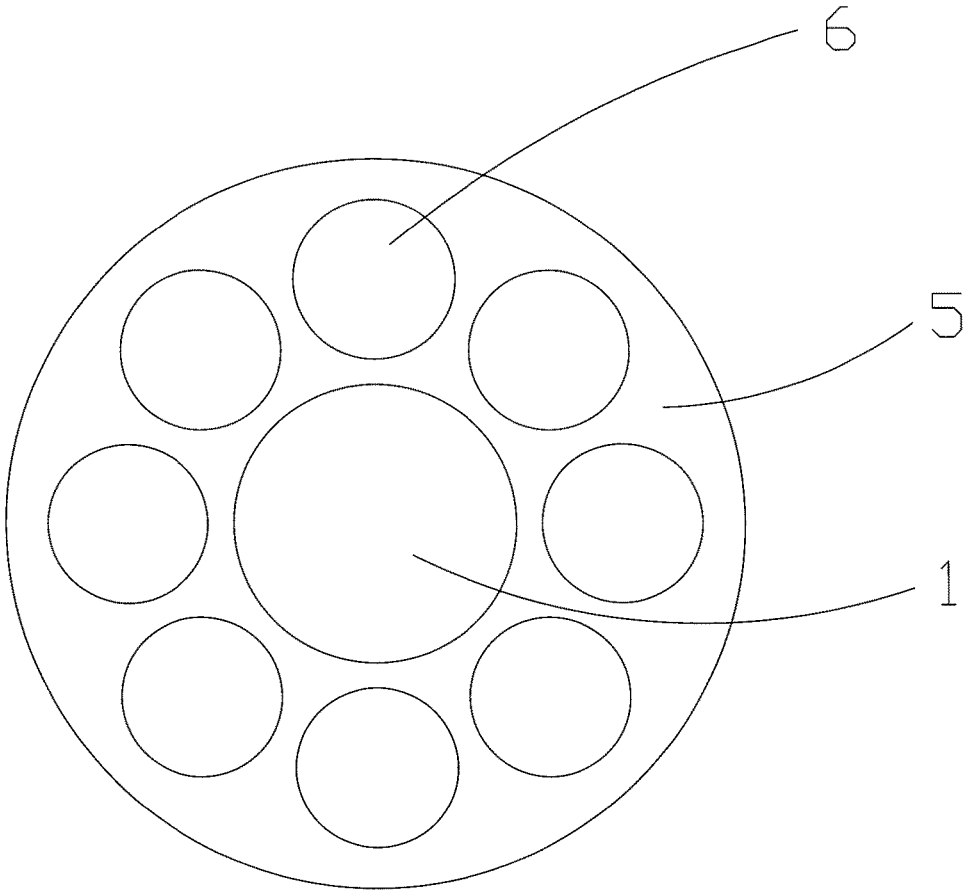
FIG. 4 is a schematic view of a further supporting member structure of the detailed description of the embodiments of the present invention.

The second embodiment of the structure of the supporting member:

In this embodiment, as shown in FIG. 4, the supporting member is an annular supporting board 5 disposed on the needle body 1, a plurality of diversion holes 6 are formed on the annular supporting board 5 as the fluid passages.

The annular supporting board 5 has appropriate thickness according to actual needs, furthermore, the shape of the diversion holes 6 is not limited to round hole as shown in FIG. 4, may be scallop hole, meanwhile, the diversion holes 6 should be formed by incurring no influence or slight influence on the flow rate of fluid, for example, an arc is provided at the connection point between the diversion holes 6 and the annular supporting board 5 in favor of the fluid flowing.

Figure 3:
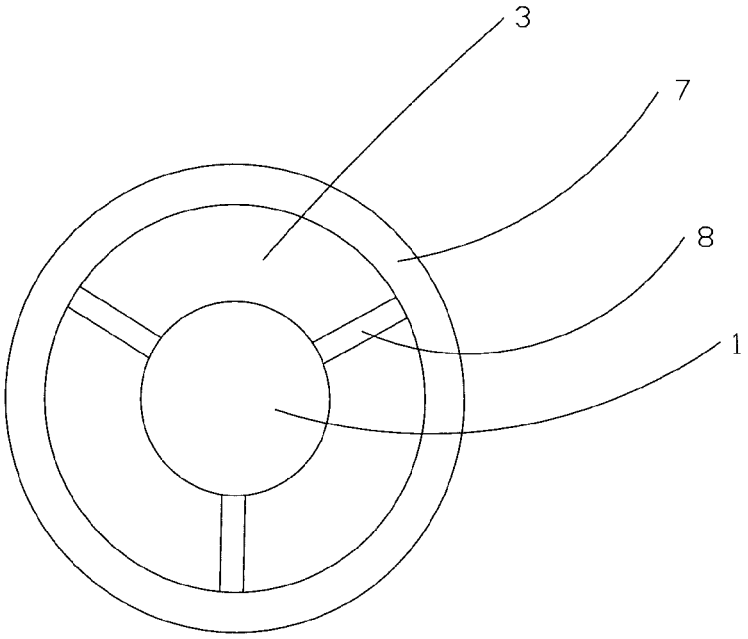
FIG. 3 is a schematic view of a supporting member structure of the detailed description of the embodiments of the present invention.

The third embodiment of the structure of the supporting member:

In this embodiment, as shown in FIG. 3, the supporting member is a circular ring 7, the circular ring 7 is connected with the needle body 1 through a plurality of rib strips 8, and each two rib strips 8 have one fluid passage 3 formed therebetween.

The shapes of the circular ring 7 and the rib strips 8 are in favor of the fluid flowing smoothly to have a slight influence or no influence on fluid flowing.

The description of three structural types of the supporting member is presented above, but it is not limited hereto.

Furthermore, as shown in FIG. 1, after the needle coordinates with the nozzle, and when the conical portion of the needle completely coordinate with the water outlet, in order to avoid the interference between the supporting member and the conical surface of the inner cavity at the water outlet, preferably, the supporting member of the needle body 1 and the conical portion 2 of the needle body 1 have a water pressurizing and mixing segment 1*a* formed therebetween, and the water pressurizing and mixing segment 1*a* is cylindrical in shape, so as to form a space for the cold water inflowing between the water pressurizing and mixing segment 1*a* of the needle and the inner cavity wall of the nozzle after the needle is assembled to the nozzle, as shown in FIG. 2, which may ensure the incoming fluid through the fluid passages is uniformly mixed before it get into the conical surface formed by the conical portion 2 and the water outlet 10 and pressurizing effect can be achieved, so as to ensure the final jetting effect of the nozzle.

As shown in FIG. 2, when the needle 9 is moved toward the water outlet 10 in the axial direction of the nozzle 10, the conical portion 2 of the needle gradually coordinates with the water outlet 10, therefore, after the conical portion 2 is completely coordinates with the water outlet 10, in order to prevent further cold water from spurting from the water outlet 10, preferably, the diameter of the water pressurizing and mixing segment 1*a* is larger than, or equal to, or slightly smaller than the diameter of a water outlet (10) of the nozzle.

"Larger than, equal to" here, means the water outlet 10 is sealed by the water pressurizing and mixing segment 1*a*, after conical portion 2 completely coordinates with the water outlet 10, so as to prevent the cold water from spurting from the water outlet 10.

"Slightly smaller than" here, means there is a very slight difference between the diameter of the water pressurizing and mixing segment 1*a* and the diameter of the water outlet 10, i.e., after the conical portion 2 coordinates with the water outlet 10, a slight gap is provided between outer circumferential surface of the water pressurizing and mixing segment 1*a* and inner circumferential surface of the water outlet 10, although a little cold water may be spurted from the water outlet 10 through the gap, the slight effect on the hot water flowing through the outer wall of the nozzle 9 can be ignored.

The length of the water pressurizing and mixing segment 1*a* should not be too short, otherwise it may cause the water from the nozzle to the bifurcation, i.e., the length of the water pressurizing and mixing segment 1*a* is relate to the cross-section of the fluid passage, the cross-section of the nozzle outlet and the thickness of the supporting member, but this impact will not be significant.

Furthermore, as shown in FIG. 1, the diameter of the conical portion 2 is larger at a root 2*a* thereof and smaller at a front end 2*b* thereof, and the conical degree of the conical portion 2 is 10°-150°, the conical degree comprises 10° and 150°, after the needle is assembled to the nozzle, the length of the conical portion 2 is smaller than or equal to the length for which the nozzle is movable, so that appropriate coordination between the water outlet 10 and the conical portion 2 can be achieved.

In addition, the diameter of the conical portion 2 is gradually reduced in a linear manner from the root 2*a* to the front end 2*b*, i.e. the conical portion is a cone in structure. For the fluid flowing smoothly, as shown in FIG. 2, the coordination between the conical portion 2 and the water outlet may be linear. The conical portion 2 may be of a non-linear or parabolic surface, so as to make some appropriate adjustments automatically in accordance with different flow rates of fluid.

Obviously, the aforementioned embodiments are merely intended for clearly describing the examples, rather than limiting the implementation scope of the invention. For those skilled in the art, various changes and modifications in other different forms can be made on basis of the aforementioned description. It is unnecessary to describe all the implementation ways herein. However, any obvious changes or modifications derived from the aforementioned description are intended to be embraced within the scope of protection of the present invention.

What is claimed is:

1. A needle for a jet device, comprising a needle body, and a conical portion disposed on one end of said needle body, wherein said needle body is circumferentially provided with a supporting member, and an outer surface of said supporting member is adapted to coordinate with an inner cavity of a nozzle, in order to limit a position of said needle body to form a fluid on said supporting member when said needle is disposed inside said nozzle;

wherein said supporting member comprises a plurality of ribs uniformly and circumferentially arranged around said needle body and extending in an axial direction of said needle body, and each adjacent two of said plurality of ribs have one said fluid passage formed therebetween;

wherein each of said ribs comprises a first rib part and a second rib part, and said first rib part is arranged towards a cold water inlet of said nozzle and has a radial dimension smaller than that of said second rib part, so as to be adapted to coordinate with said inner wall of said nozzle to form said fluid passage, and a coordination is formed between an outer surface of said second rib part and said inner cavity of said nozzle;

wherein said supporting member of said needle body and said conical portion have a water pressurizing and mixing segment formed therebetween, and said water pressurizing and mixing segment is cylindrical in shape;

wherein the first rib part has a length which is equal to a sum of a length of the cold water inlet of the nozzle in the axial direction and a length along which the nozzle is movable.

2. The needle of claim 1, wherein a number of said ribs is three, four, five or six.

3. The needle of claim 1, wherein a diameter of said water pressurizing and mixing segment is larger than that of a water outlet of said nozzle.

4. The needle of claim 1, wherein a diameter of said conical portion is larger at a root thereof and smaller at a front end thereof, and a conical degree of said conical portion is 10 degrees to 150 degrees, and a length of said conical portion is smaller than or equal to a length for which said nozzle is movable.

5. The needle of claim 4, wherein the diameter of said conical portion is continuously reduced in a linear manner from said root to said front end.

6. The needle of claim 4, wherein a number of said ribs is three, four, five or six.

* * * * *